US007476058B2

(12) United States Patent
Scheunert

(10) Patent No.: US 7,476,058 B2
(45) Date of Patent: Jan. 13, 2009

(54) MINING ROOF SUPPORT FRAME WITH BASE SKIDS LIFTING DEVICE

(75) Inventor: Alois Scheunert, Recklinghausen (DE)

(73) Assignee: DBT Bergbau-Service GmbH, Hamm (DE)

( * ) Notice: Subject to any disclaimer, the term of this patent is extended or adjusted under 35 U.S.C. 154(b) by 384 days.

(21) Appl. No.: 11/474,885

(22) Filed: Jun. 23, 2006

(65) Prior Publication Data

US 2007/0065236 A1 Mar. 22, 2007

(51) Int. Cl.
*E21D 23/04* (2006.01)

(52) U.S. Cl. ..... 405/296; 405/291; 405/288

(58) Field of Classification Search ..... 405/288, 405/290, 291, 296, 298, 299
See application file for complete search history.

(56) References Cited

U.S. PATENT DOCUMENTS 4,797,023 A * 1/1989 Park ..... 405/291
5,190,414 A * 3/1993 Bemmerl et al. ..... 405/296

FOREIGN PATENT DOCUMENTS

| | | |
|---|---|---|
| DE | 385525 | 4/1990 |
| DE | 4430337 | 4/1995 |
| DE | 4401240 | 7/1995 |
| DE | 20316659 | 1/2004 |

OTHER PUBLICATIONS

International Search Report PCT/EP2004/013844.

* cited by examiner

*Primary Examiner*—Frederick L Lagman
(74) *Attorney, Agent, or Firm*—Fay Sharpe LLP; Karl W. Hauber

(57) ABSTRACT

The disclosure concerns a mining roof support frame including at least one hydraulic lifting ram which is mounted on a bridging member connecting two base skids of the main frame, and which by way of a pressure-generated force can be extended downward against a walking bar of the walking unit of the mining roof support frame located between the base skids. In accordance with the disclosure, the base skids lifting device is connected with the bridging member such that it can pivot. With walking unit ram pivot pins withdrawn only on one side, the base skids lifting device can be pivoted out of the way about opposing pivot pins.

19 Claims, 2 Drawing Sheets

MINING ROOF SUPPORT FRAME WITH BASE SKIDS LIFTING DEVICE

BACKGROUND

The disclosure relates to a mining roof support frame, in particular a shield roof support frame, comprising a main frame, two base skids, and a base skids lifting device including at least one hydraulic lifting ram. The lifting ram can be mounted on a bridging member connecting the two base skids of the main frame. A pressure-generated force can be extended downward against a walking bar of a walking unit of the mining roof support frame located between the base skids. The disclosure concerns also the base skids lifting device for mining support assemblies itself.

Shield support assemblies with base skids lifting devices are of known art in various embodiments (DE 40 35 252 A1, DE 42 05 940 A1). The use of a base skids lifting device is particularly recommended in circumstances where the roof support frame with its base skids presses into the soft floor so deeply when in use as a result of the suspended load, that the walking process is impeded. The floor conditions can vary from site to site, and also can be subject to variations within the same site. If the hydraulic lifting ram is connected to the bridging member that connects the two base skids of the roof support frame and bridges across the walking unit channel between the two base skids, and the lifting ram is located such that in the retracted state it lies with its lower support foot below the lower edge of the bridging member, then it can occur, particularly in the case of uneven and very soft floors, that the base skids dig so deeply into the floor as a result of the suspended load that the retracted lifting ram makes contact with the walking bar and is subject to high loadings. This results inevitably in the destruction of the lifting ram, or to a shearing off of the lifting ram from the bridging member.

The known state of the art technology furthermore attracts the disadvantage that during servicing or repair tasks on the walking bar or walking ram, time-intensive bolting tasks are required for the disassembly and assembly of the connecting parts receiving the lifting ram from the bridging member that rigidly connects the base skids. In addition, the bolted joints that are used are subject to shearing forces. Moreover, the lifting ram with the connecting parts must be removed from its position or fixed in position manually by a miner working underground under difficult conditions.

SUMMARY

The disclosure provides a base skids lifting device for mining support assemblies that is easier to service, ergonomic to manipulate, and by virtue of its design excludes any overload of the means of connection between the connecting part and the bridging member. In accordance with the disclosure, the base skids lifting device can be connected with the bridging member such that it can pivot.

The disclosure further provides a mining roof support frame comprising a shield roof support frame including a main frame, two base skids, and at least one hydraulic lifting ram of a base skids lifting device mounted on a bridging member connecting the two base skids of the main frame. The lifting ram including a pressure-generated force extending downward against a walking bar of a walking unit located between the base skids of the mining roof support frame, wherein the base skids lifting device is pivotably connected with the bridging member.

Additionally, in accordance with the disclosure, a base skids lifting device is provided for a mining roof support frame comprising a shield roof support frame including a main frame and two base skids. At least one hydraulic lifting ram can be mounted on a bridging member connecting the two base skids of the main frame producing a pressure-generated force extending downward against a walking bar of a walking unit of the mining roof support frame located between the base skids. The base skids lifting device is selectively connectable and pivotable with the bridging member.

In one exemplary embodiment, the base skids lifting device is arranged on the bridging member such that it can be pivoted horizontally, in particular, such that it can be pivoted horizontally about a vertical pivot axis wherein the vertical pivot axis is formed by pivot pins that can be disassembled. It is advantageous if the base skids lifting device can be pivoted as needed, or as selected, about either a left-hand or a right-hand vertical pivot axis. In another embodiment, the base skids lifting device can be pivoted in the first instance about a lower duplex bearing and an upper simplex bearing. Alternatively, the base skids lifting device can be pivoted around two simplex bearings, where the simplex bearings are arranged on the inner side of the pivot bearing. By means of the location of both simplex bearings on the inner side relative to the base skids, and consequently underneath the pivot bearing, the base skids lifting device can be supported in each case on the bridge side or roof support frame side simplex bearings. Alternatively, by arrangement of one, i.e. the lower, simplex bearing above the pivot bearing and the other simplex bearing below the pivot bearing, the base skids lifting device can also be accommodated between the simplex bearings. The vertical forces can then, as in the case of a duplex bearing, be transmitted to the bridge side or roof support frame side simplex bearings. With the use of simplex bearings, the design can be such that the vertical forces of the lifting ram are accommodated by parts attached to the bridging member and correspondingly shaped areas on the connecting part.

For the transfer of the forces of the lifting ram to the bridging member, the base skids lifting device can in particular include a pivot bracket, the rear wall of which can be fitted with at least one recess. The bridging member can be fitted with at least one thrust piece against which the recess comes into contact during the lifting movement. Furthermore, a tie bar can be mounted on the pivot bracket. The tie bar can be connected via a head piece with the piston rod head.

In accordance with the disclosure, the lifting device no longer has to be dismantled in a resource intensive manner for servicing tasks on the walking bar or walking ram, but rather after removal of the pivot pins on one side only can be pivoted out of the way, and any excess vertical forces that may occur are eliminated in a simple manner.

The disclosure is now described in more detail with reference to exemplary embodiments represented in the drawings.

DETAILED DESCRIPTION

Figure 1:
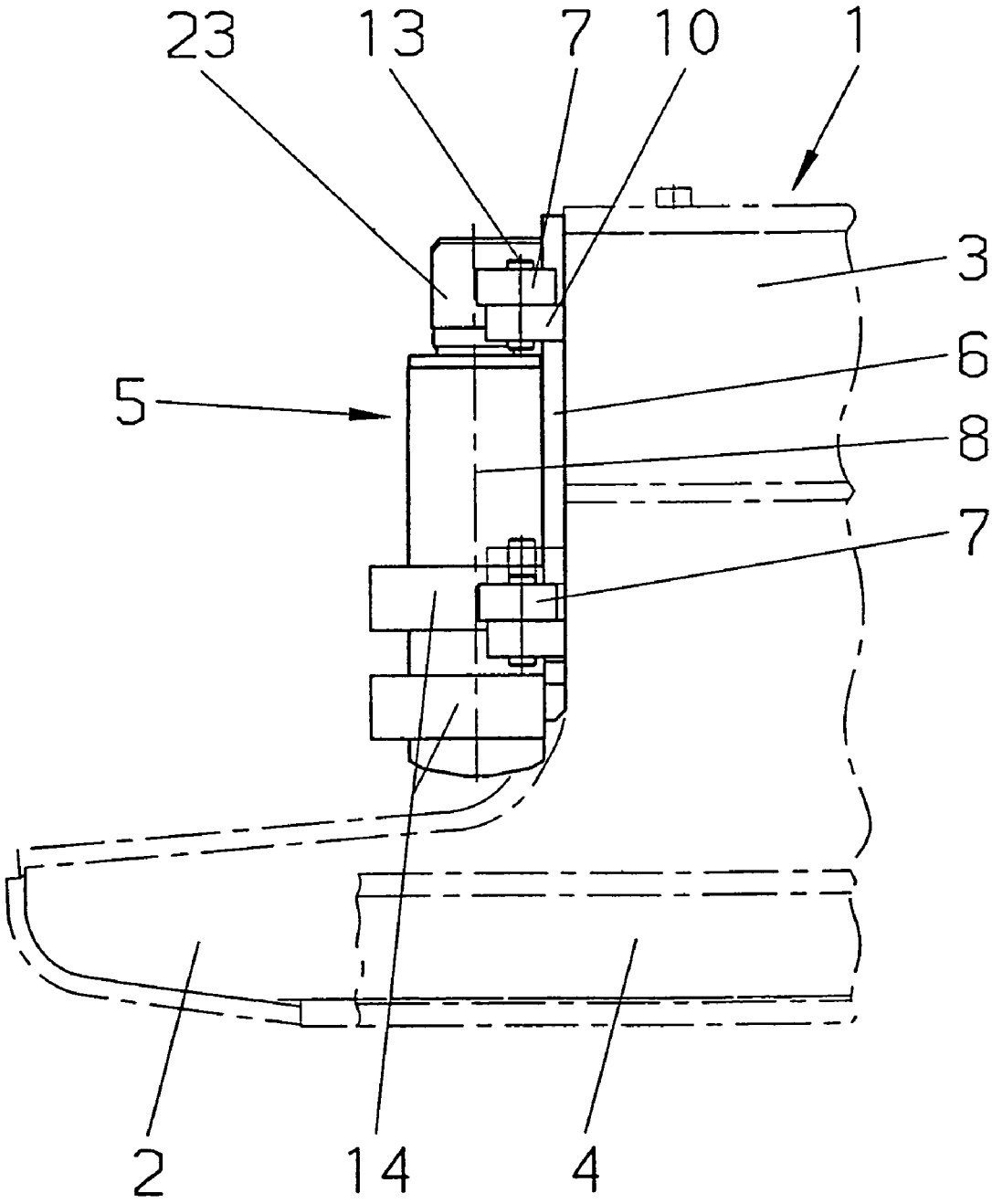
FIG. 1 shows a side view of a simplified schematic of a mining roof support frame fitted with a base skids lifting device in accordance with the disclosure.
Figure 2:
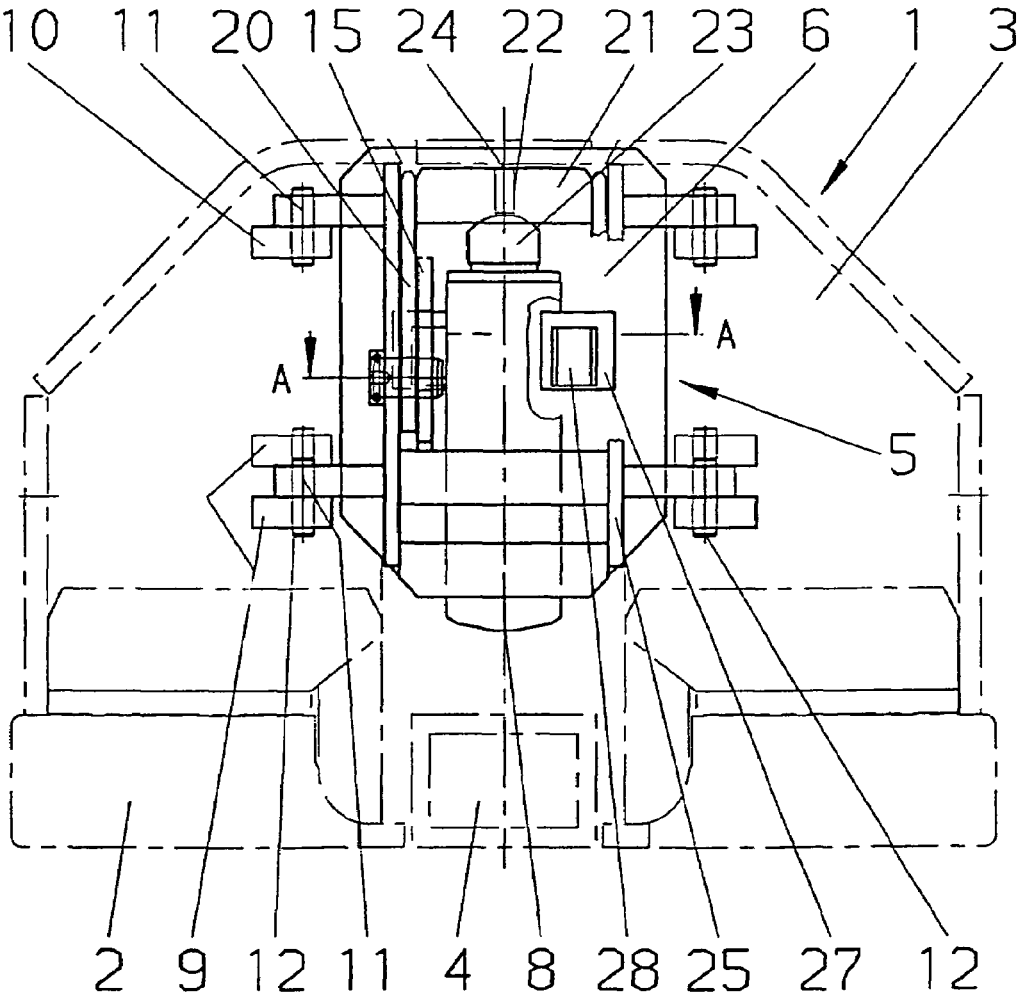
FIG. 2 shows a part view from the direction of the working face.

FIGS. 1 and 2 show parts of an exemplary embodiment of the base skids of a mining roof support frame or shield roof support frame 1 including a main frame. This embodiment of the base skids comprises two base skids 2 that are located parallel to each other with a lateral gap space between them, and which are rigidly connected together by means of a bridging member 3. In the space between the two base skids 2 is located a walking bar 4 of a walking unit for advancing forward of an underground conveyor, of which no further details are shown, or for the pulling of the shield 1. At its working face end the walking bar 4 is connected to a longwall face conveyor by means of a connecting link. A walking ram is introduced between the bridging member 3 and the walking bar 4. Since the technology associated with walking units for mining support assemblies is part of the general knowledge of a specialist in underground mining and is technology with which he/she will be familiar, no representation in the form of figures or any further description will be provided here.

Figure 3:
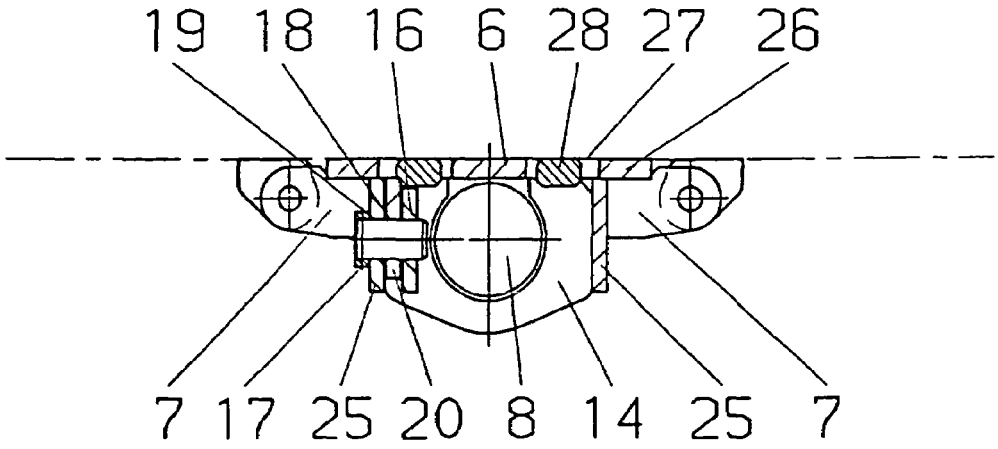
FIG. 3 shows a part view from the vertical direction, corresponding to line A-A in FIG. 2.

The mining roof support frame 1 can be fitted with a base skids lifting device 5, the construction of which is now described with reference to FIGS. 1-3.

FIG. 2 shows a hydraulic lifting ram 8 that can be retracted and extended. The ram 8 can be connected with a piston rod head 23 of the piston rod in a head piece 21 by means of a securing bolt 24, which is guided through a vertical bore 22 in the head piece 21. The head piece 21 is part of a tie bar 20, which by way of mounting links 15 and side walls 25 can be connected to the base skids lifting device 5. The connecting parts can also include a horizontal bore 16 in the mounting link 15, a tie bearing bore 18 in the tie bar 20, a bolt seating 19 in the side wall 25, as well as a tie bearing 17 with a bolt that passes through the bores 19, 16, 18 that are aligned flush with each other. Lifting ram guides 14 can be welded in between the side walls 25. The former are also connected at the same time with the mounting links 15 by welded joints, for example. Facing the bridging member 3 is a pivot bracket 6, which can be welded to the side walls 25, the lifting ram guides 14, and the mounting links 15. Pivot bearings 7 can be welded onto the vertically-oriented edges of the pivot bracket 6.

In a different configuration, duplex bearings 9 and also simplex bearings 10 can be connected with the bridging member 3 by welding. In an exemplary embodiment shown, the duplex bearing 9, with two bearing flanges having a separation between them, and the pivot bearing 7 accommodated between the bearing flanges, form the lower bearing locations. The simplex bearings 10, with only one bearing flange located below the pivot bearing 7, form the upper bearing locations. The pivot bearings 7 of the pivot bracket 6 can be connected with the duplex bearings 9 and the simplex bearings 10 by the insertion of pivot pins 12. The pivot pins 12 can be secured in position by means of pin fixings 13, and thus enable the pivot bracket 6 to have the ability to pivot about the vertical pivot axis 11.

The duplex bearings 9 that are shown in FIG. 2 enable the transmission of the vertical forces imposed on the lifting ram 8 via the tie bar 20 into the bridging member 3 and thus a raising of the base skids 2 during the walking process of the mining roof support frame 1. These duplex bearings 9 can, as shown, form both the lower and the upper bearing locations, or alternatively can form just the lower or the upper bearing location. The hydraulic lifting ram 8, which is mounted on the bridging member 3 connecting the two base skids 2 of the main frame, can be extended by a pressure-generated force downward against the walking bar 4 of the walking unit of the mining roof support frame 1 located between the base skids. The base skids lifting device 5 is connected with the bridging member 3 such that it can pivot. During servicing tasks on the walking bar 4 or the walking unit ram, pivot pins 12 can be extracted only on one side and the base skids lifting device 5 can then be pivoted out of the way around the opposing pivot pins 12.

An alternative option for the transmission of the aforesaid vertical forces is provided if the simplex bearings 10, in both the upper and the lower bearing positions, are located on the inner side.

It is to be appreciated that the transmission of the vertical forces is revealed in FIG. 2 and FIG. 3 and described below. A rear wall 26 of the pivot bracket 6 can be fitted with two recesses 27. The two recesses 27 overlap thrust pieces 28 that are welded onto the bridging member 3. When a load is applied to the lifting ram 8, the recesses 27 come into contact with the thrust pieces 28 and transmit the lifting forces into the bridging member 3 thereby ensuring the raising of the base skids 2.

FIG. 1 displays the connection of the base skids lifting device 5 to the bridging member 3. Similarly, it can be seen from this figure that the lifting ram 8 is not in contact with the walking bar 4, which signifies that the mining roof support frame is in the seated state.

It will be appreciated that variants of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

LIST OF NUMBER REFERENCES

1 Mining roof support frame
2 Base skid
3 Bridging member
4 Walking bar
5 Base skids lifting device
6 Pivot bracket
7 Pivot bearing
8 Lifting ram
9 Duplex bearing
10 Simplex bearing
11 Vertical pivot axis
12 Pivot pin
13 Pin fixing
14 Lifting ram guide
15 Mounting link
16 Horizontal bore
17 pulling bearing
18 pulling bearing bore
19 Bolt seating
20 Tie bar
21 Head piece
22 Vertical bore
23 Piston rod head
24 Fixing bolt
25 Side wall
26 Rear wall
27 Recess
28 Thrust piece

The invention claimed is:

1. A mining roof support frame comprising:

a shield roof support frame including a main frame, two base skids, and at least one hydraulic lifting ram of a base skids lifting device mounted on a bridging member connecting the two base skids of the main frame; and, the lifting ram including a pressure-generated force extending downward against a walking bar of a walking unit located between the base skids of the mining roof support frame, wherein the base skids lifting device is pivotably connected with the bridging member.

2. The mining roof support frame in accordance with claim 1, wherein the base skids lifting device is located on the bridging member and pivots horizontally about a vertical pivot axis.

3. The mining roof support frame in accordance with claim 2, wherein the base skids lifting device is selectively pivotable about a left-hand or right-hand vertical pivot axis.

4. The mining roof support frame in accordance with claim 2, wherein the base skids lifting device pivots about a lower duplex bearing and an upper simplex bearing.

5. The mining roof support frame in accordance with claim 2, wherein the base skids lifting device pivots about two simplex bearings located on the inner side of the pivot bearing.

6. The mining roof support frame in accordance with claim 1, wherein the base skids lifting device pivots about pivot bearings including removable pivot pins.

7. The mining roof support frame in accordance with claim 1 wherein the base skids lifting device including a pivot bracket having a rear wall fitted with at least one recess.

8. The mining roof support frame in accordance with claim 1 wherein the bridging member including at least one thrust piece.

9. The mining roof support frame in accordance with claim 7, wherein a tie bar is mounted on the pivot bracket.

10. The mining roof support frame in accordance with claim 9, wherein the tie bar including a head piece is connected with a piston rod head.

11. A base skids lifting device for a mining roof support frame comprising:

a shield roof support frame including a main frame and two base skids, at least one hydraulic lifting ram mounted on a bridging member connecting the two base skids of the main frame producing a pressure-generated force extending downward against a walking bar of a walking unit of the mining roof support frame located between the base skids; and, the base skids lifting device is selectively connectable and pivotable with the bridging member.

12. The base skids lifting device in accordance with claim 11, wherein the lifting device is pivotable about a vertical pivot axis.

13. The base skids lifting device in accordance with claim 11, wherein the lifting device is selectively pivotable about a left-hand or right-hand vertical pivot axis.

14. The base skids lifting device in accordance with claim 12, further comprising a lower duplex bearing and an upper simplex bearing about which the lifting device is pivoted.

15. The base skids lifting device in accordance with claim 12, further comprising two simplex bearings about which the lifting device is pivoted wherein the simplex bearings are located on the inner side of the pivot bearing.

16. The base skids lifting device in accordance with claim 11, further comprising pivot bearings about which the lifting device is pivoted wherein the pivot bearings include removable pivot pins.

17. The base skids lifting device in accordance with claim 11, further comprising a pivot bracket including a rear wall with at least one recess therein.

18. The base skids lifting device in accordance with claim 17, further comprising a tie bar mounted in the pivot bracket.

19. The base skids lifting device in accordance with claim 18, wherein the tie bar including a head piece is connected with a piston rod head.

* * * * *